US005692877A

United States Patent [19]

Sixtensson

[11] Patent Number: 5,692,877

[45] Date of Patent: Dec. 2, 1997

[54] MEANS AND METHOD FOR STACKING THIN SHEETS

[75] Inventor: Roland Sixtensson, Vetlanda, Sweden

[73] Assignee: Ingenjörsfirman Rationella Maskiner AB, Vetlanda, Sweden

[21] Appl. No.: 507,336

[22] PCT Filed: Feb. 14, 1994

[86] PCT No.: PCT/SE94/00122

§ 371 Date: Oct. 11, 1995

§ 102(e) Date: Oct. 11, 1995

[87] PCT Pub. No.: WO94/18105

PCT Pub. Date: Aug. 18, 1994

[30] Foreign Application Priority Data

Feb. 15, 1993 [SE] Sweden ..... 9300487

[51] Int. Cl.[6] ..... B65H 29/58

[52] U.S. Cl. ..... 414/791.1; 271/215; 271/290; 271/294; 414/786; 414/790.7; 414/798.2

[58] Field of Search ..... 271/215, 287, 271/299, 290, 294; 414/786, 789, 790.7, 790.9, 791.1, 798.2, 798.7

[56] References Cited

U.S. PATENT DOCUMENTS 3,236,162 2/1966 Reist ..... 414/798.2 X
3,343,690 9/1967 Dean ..... 414/798.2 X
3,719,266 3/1973 Korn et al. ..... 414/798.2
3,884,345 5/1975 Tokuno ..... 414/798.2 X
4,055,339 10/1977 Looney ..... 271/294 X

*Primary Examiner*—Janice L. Krizek
*Attorney, Agent, or Firm*—Cohen, Pontani, Lieberman & Pavane

[57] ABSTRACT

The present invention is for a method of stacking of thin sheets and a device for stacking of thin sheets according to the method. The sheets can be made from paper, plastic film or the like. The invention is primarily intended to be used in connection with print outs in computer centers delivering a continuous, rapid and lengthy flow of paper sheets. The paper is brought into the stacker on a conveyer (4) comprising a number of parallel bands arranged side by side, which are controlled by pulley wheels and supporting wheels (5, 6, 7, 8). The papers are delivered from the conveyer (4) in the slit between the paper stack (16) and a second conveyer (9) which also comprises a number of parallel bands arranged sidewise passing over pulley wheels (10 and 24). The paper stack is supported by several supports (14) each having a resilient supporting edge (17) towards the paper stack. The stacker can be turned and tilted around an axis (25) at right angle to the plane of the FIGURE.

6 Claims, 1 Drawing Sheet

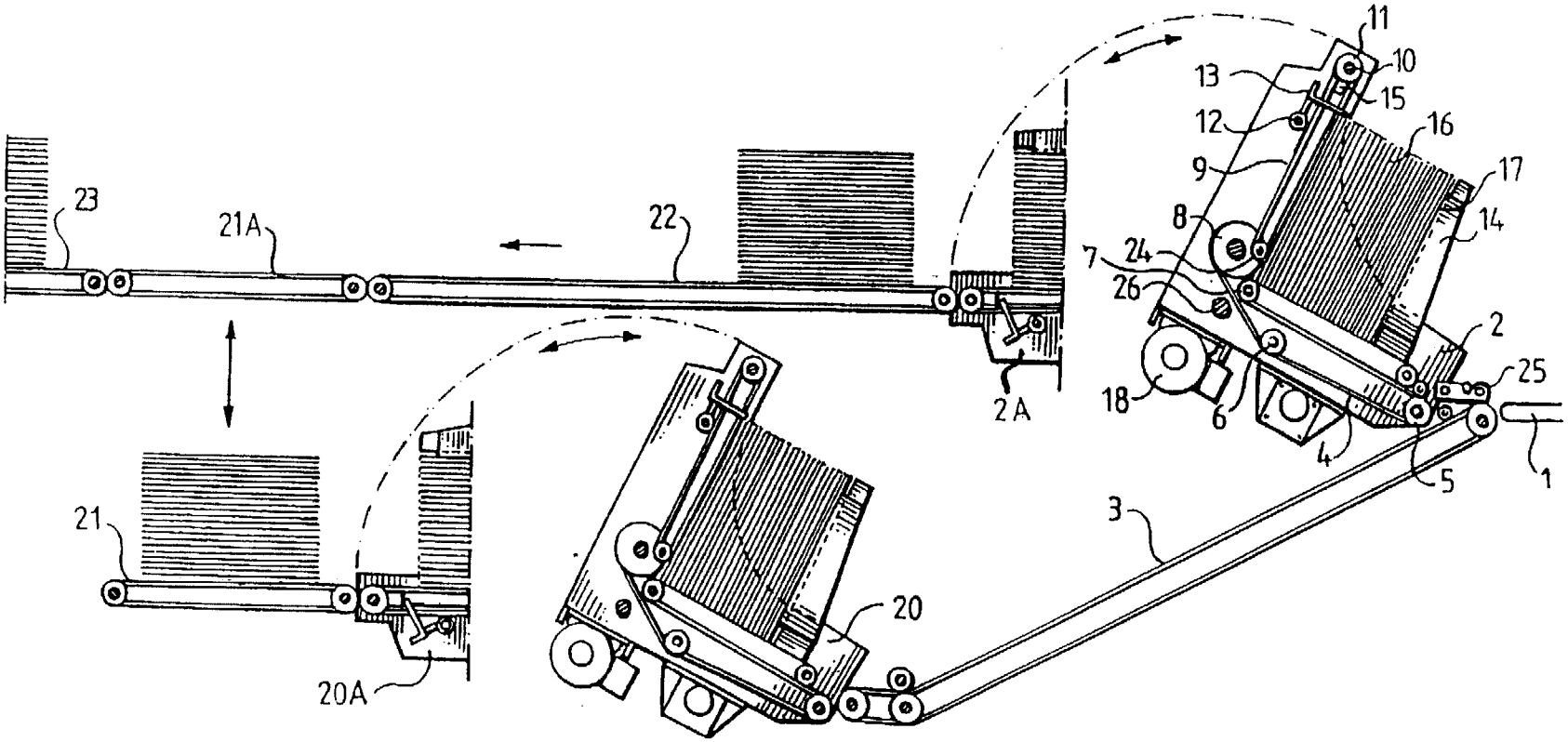
1
2
2A
3
4
5
6
7
8
9
10
11
12
13
14
15
16
17
18
20
20A
21
21A
22
23
24
25
26

MEANS AND METHOD FOR STACKING THIN SHEETS

The present invention concerns a method for stacking of thin sheets and a device for stacking of thin sheets according to the method. The sheets can be made from paper, plastic film or the like. The invention is primarily intended to be used in connection with print-outs in computer centres delivering a continuous, rapid and lengthy flow of paper sheets.

At larger computer centres there is often an almost continuous production of print-outs. The printers used for this purpose have a great capacity and the speed of the paper can be up to 1 meter per second, corresponding to 4–6 sheets per second.

The printed papers are collected in stacks for further handling. A suitable height of a stack is up to 200 mm, which means that each such stack contains more or less numerous sets of print-outs for different adressees. In order to facilitate the further handling those parts of the stack which are intended for a certain adressee should be displaced relative to the adjacent parts of the stack. Separating stacks by addressee is particularly important with the use of certain high speed printing devices that produce a high speed continuous printed sheet output which is subsequently split up into separate sheets, possibly intended for different addressees. In order to facilitate this handling, the print-outs often have a bar code, either on each separate sheet or on the first and possibly the last paper for an addressee, whereupon the continuous paper sheets can be controlled by impulses which are received directly from the printer or by optical reading of the bar codes. It is then important that there is no further displacement of the paper in relation to other papers.

The invention will below be described more in detail with reference to the embodiment shown in the accompanying FIGURE.

The device shown in the FIGURE has two stackers 2, 20 for collecting of separate sheets to stacks of suitable size. The papers arrive to the device on a conveyer 1 and are received in a paper switch 25 where the paper is directed using air. The paper directed upwards is carried on to the upper stacker 2 and papers directed downwards are brought to the lower stacker 20 by the conveyer 3. The two stackers are of identical design and function. The paper is brought into the stack on a conveyer 4 comprising a number of parallel bands arranged side by side, which are controlled by pulley wheels and supporting wheels 5, 6, 7, 8. The papers are delivered from the conveyer 4 in the slit between the paper stack 16 and a second conveyer 9 which also comprises a number of parallel bands arranged sidewise passing over pulley wheels 10 and 24. The paper stack is supported by several supports 14 each having a resilient support edge 17 towards the paper stack. The stacker can be turned and tilted around an axis 26 at right angle to the plane of the FIGURE.

A paper incoming to the stacker from the conveyer 1 passes the paper switch 25 and it directs the paper towards the upper stacker 2. The paper is caught onto the conveyer bands 4 and leave these after passing under the pulley wheels 7. The paper is then directed at an angle inwards towards the paper stack 16 and is brought up so that it passes in between the stack and the conveyer bands 9. These bands pass over-upper pulley wheels 11 and lower pulley wheels 24. The lower pulley wheels 24 are mounted onto a shaft which is mounted onto arms extending up to the shaft 10 through the centre of the upper pulley wheels 11. The lower pulley wheels 24 can swing freely in this suspension device and if the rear supports 14 are in a certain position the pulley wheels 24 move gradually when further paper is delivered to the stack. In connection with this movement a position switch 15 is affected by the pivoting arrangement of the pulley wheels 24. The supports 14 are arranged so that they can be displaced in a direction towards or away from the conveyer bands 9. This displacement arrangement is effected by the position switch 15 and as the paper stack increases the supports 14 are moved away from the driving arrangement in small steps of 1–2 mm. The papers brought into the apparatus on the conveyer 1 are to have the text on the upper side. In this way the papers in the stack will be placed in order with the first paper on top and the last paper on the bottom.

The maximum size of the stack is decided by the maximum allowed distance between the conveyer bands 9 and the supports 14. The desired size of a completed stack can, however, be controlled by different criteria, e.g. by means of a counting device determining the number of sheets or by measuring the thickness or weight of the stack. The above mentioned bar codes can be used to control the stacking so that papers which belong together are not put into different stacks, but one stack is completed with the last paper for a certain addressee.

When the last paper of a stack is directed to the correct stacker, the paper switch 25 is shifted, which in this case means that the papers are directed to the conveyer 3 and conveyed to the lower stacker 20 where the papers are collected as described for the upper stacker. When the last paper has been put into position in the stacker 2, this is turned around the shaft 26 into a position which in the FIGURE is marked by a part of a stacker 20A. The fork-shaped stopper 13, against which incoming papers knock, is pivotally suspended from a shaft 12 and drops down to a position under the upper part of the conveyer 9, so that the papers are no longer prevented from moving in a direction to the left in the FIGURE. In connection with the tilting of the stacker its driving motor 18 is disconnected and the conveyer bands 9 are connected to the driving conveyer 22. The stack is then brought out until it is on the conveyer 22 in the position as shown in the FIGURE. The stacker has then been emptied and is tilted back into its starting position, whereby also the supports 14 are brought back to a position adjacent to the conveyer bands 9 and the stacker is then ready to receive new papers.

When the lower stacker 20 contains a completed stack this is delivered in the same way as described above to a conveyer 21. This conveyer is movable in a vertical direction and can be raised up to the position marked 21A and is then a part of a continuous conveyer comprising a first conveyer band 22, the movable conveyer 21 and a final delivery conveyer band 23. The transport of the stack sis controlled in such a way that the upper paper of one stack on the conveyer 23 is the paper following directly after the bottom paper in the preceding stack.

I claim:

1. An apparatus for high speed continual stacking of a plurality of sheets connected to an initial sheet delivery conveyor for delivering sheets to be stacked to the apparatus and to a final stack delivery conveyor for removing stacked sheets from the apparatus, said apparatus comprising:

a plurality of sheet stacking devices of a predetermined capacity, each said stacking device comprising receiving means for receiving at least a portion of said plurality of sheets from the initial sheet delivery conveyor, stacking means connected to said receiving means for forming a stack of sheets from said at least a portion of said plurality of sheets, detection means for determining when said stack has reached the predetermined capacity, and first control means for:

(1) setting said stacking device to a stacking position if the predetermined capacity is not reached, wherein said stacking means is active and said stacking device is positioned and configured to receive at least a portion of said plurality of sheets from the initial sheet delivery conveyor, and (2) setting said stacking device to an unloading position when said predetermined capacity is reached, wherein said stacking means is inactive and said stacking device is positioned and configured to deliver said stack to the final stack delivery conveyor; and second control means, connected to said first control means of each of said plurality of stacking devices and to the initial sheet delivery conveyor, for directing a flow of said plurality of sheets from the initial delivery conveyor away from a first stacking device of said plurality of stacking devices and toward a second stacking device of said plurality of stacking devices when said first stacking device is in said unloading position, and for causing said first control means of said second stacking device to set said second stacking device into said stacking position when said plurality of sheets is directed to said second stacking device;

said second control means being further configured for directing said plurality of sheets away from said second stacking device to said first stacking device when said second stacking device is in said unloading position, and for causing the first control means of said first stacking device to set said first stacking device into said stacking position to receive said plurality of sheets, so that said first and said second stacking devices alternate in forming stacks from said plurality of sheets received from the initial sheet delivery conveyor and in unloading formed stacks to the final stack delivery conveyor, thereby continually producing stacks of sheets.

2. The apparatus of claim 1, further comprising means for selecting the predetermined capacity of at least one stacking device of said plurality of stacking devices.

3. The apparatus of claim 1, wherein said detection means comprises at least one of a counting means for counting a number of sheets in said stack, means for measuring a height of said stack, and means for measuring a weight of said stack.

4. The apparatus of claim 1, wherein said stacking means comprises an adjustable stacking area, and wherein said receiving means comprises at least one conveyor for transferring each sheet of said at least a portion of said plurality of sheets to said stacking area.

5. The apparatus of claim 1, further comprising a stack receiving means positioned between said plurality of stacking devices and the final delivery conveyor for transferring at least one stack from said plurality of stacking devices to the final delivery conveyor, said stack receiving means comprising:

a vertically movable first conveyor having a first end and a second end;

a second conveyor having a proximal end aligned with said first stacking device when said first stacking device is in said unloading position, and a distal end; and third control means for activating said first conveyor and for raising said first conveyor into an upper position, wherein said first end of said first conveyor is horizontally aligned with the final stack delivery conveyor, when said first stacking device is in said unloading position such that a stack delivered from said first stacking device travels along said second and said first conveyors to the final stack delivery conveyor, and for deactivating and lowering said first conveyor to a lower position wherein said second end of said first conveyor is aligned with said second stacking device when said second stacking device is in said unloading position, such that a stack delivered from said second stacking device is raised by said first conveyor to said upper position and subsequently transported to the final stack delivery conveyor when said first stacking device is set to said unloading position.

6. A method for high speed continual stacking of a plurality of sheets received from an initial sheet delivery conveyor, the stacked sheets being delivered to a final stack delivery conveyor, comprising the steps of:

(a) receiving at least a portion of said plurality of sheets from the initial sheet delivery conveyor into a stacking device of a predetermined capacity;

(b) forming a stack from said at least a portion of said plurality of sheets in said stacking device;

(c) determining whether said stack has reached the predetermined capacity;

(d) setting said stacking device to a stacking position when the predetermined capacity is not reached, performing said steps (a), (b), and (c) until said predetermined capacity is reached, and setting said stacking device to an unloading position when the predetermined capacity is reached to deliver said stack formed at step (c) to the final stack delivery conveyor;

(e) directing said plurality of sheets away from said stacking device to another stacking device of a predetermined capacity when said stacking device is set to said unloading position at said step (d), said another stacking device being substantially identical to said stacking device;

(f) setting said another stacking device into a stacking position when said plurality of sheets is directed to said another stacking device at said step (e);

(g) performing said steps (a), (b), and (c) for said another stacking device until the predetermined capacity is reached, and setting said another stacking device to an unloading position when the predetermined capacity is reached to deliver said stack formed at step (c) to the final stack delivery conveyor;

(h) directing said plurality of sheets away from said another stacking device to said stacking device when said another stacking device is in said unloading position; and (i) setting said stacking device into said stacking position to receive said plurality of sheets, such that said stacking device and said another stacking device alternate in forming stacks from said plurality of sheets received from said initial sheet delivery conveyor and in unloading said stacks to the final stack delivery conveyor, thereby continually producing stacks of sheets.

* * * * *